US009920564B2

(12) United States Patent
Ebert

(10) Patent No.: US 9,920,564 B2
(45) Date of Patent: Mar. 20, 2018

(54) CONTROL SYSTEM FOR A MOTORIZED CLOSURE ELEMENT ARRANGEMENT OF A MOTOR VEHICLE

(71) Applicant: Brose Fahrzeugteile GmbH & Co. KG, Hallstadt, Hallstadt (DE)

(72) Inventor: Frank Ebert, Memmelsdorf (DE)

(73) Assignee: Brose Fahrzeugteile GmbH & Co. KG, Hallstadt, Hallstadt (DE)

( * ) Notice: Subject to any disclaimer, the term of this patent is extended or adjusted under 35 U.S.C. 154(b) by 0 days.

(21) Appl. No.: 14/580,562

(22) Filed: Dec. 23, 2014

(65) Prior Publication Data

US 2015/0176323 A1 Jun. 25, 2015

(30) Foreign Application Priority Data

Dec. 25, 2013 (DE) ..... 10 2013 114 883

(51) Int. Cl.
*E05F 15/73* (2015.01)
*E05F 15/60* (2015.01)

(52) U.S. Cl.
CPC ..... *E05F 15/73* (2015.01); *E05F 15/60* (2015.01)

(58) Field of Classification Search
CPC ..... E05F 15/73
See application file for complete search history.

(56) References Cited

U.S. PATENT DOCUMENTS 5,844,486 A 12/1998 Barron et al.
6,275,146 B1 8/2001 Kithil et al.
6,323,761 B1 11/2001 Son
6,478,357 B2 11/2002 Zhou
7,880,481 B2 2/2011 Zangl et al.
8,027,769 B2 9/2011 Zander et al.
8,225,458 B1 7/2012 Hoffberg et al.
(Continued)

FOREIGN PATENT DOCUMENTS

DE 10235925 2/2004
DE 10254708 6/2004
(Continued)

OTHER PUBLICATIONS

German Search Report for German Patent Application No. 102013114883.2 (corresponding to PDSD 218.0095US01), dated Feb. 2, 2014 (5 pages).
(Continued)

*Primary Examiner* — Gregory J Strimbu
(74) *Attorney, Agent, or Firm* — Pauly, DeVries Smith & Deffner LLC

(57) ABSTRACT

A control system for a closure element arrangement of a vehicle includes at least one linear distance sensor to detect operator control events. A control arrangement monitors the distance sensor for one of the operator control events. A longitudinal movement cycle of a body part of an operator in a longitudinal direction comprises one of the operator control events and can be detected using the distance sensor. The control arrangement detects a transverse movement cycle of the operator body part as another one of the operator control events. The transverse movement cycle runs in a transverse direction relative to the longitudinal direction. The closure element arrangement can be driven in response to detecting either one of the operator control events.

19 Claims, 4 Drawing Sheets

(56) References Cited

U.S. PATENT DOCUMENTS

| | | | |
|---|---|---|---|
| 8,284,022 | B2 | 10/2012 | Kachouh |
| 8,606,467 | B2 | 12/2013 | Gehin |
| 8,788,152 | B2 | 7/2014 | Reimann et al. |
| 9,081,032 | B2 | 7/2015 | Lange |
| 9,283,994 | B2 | 3/2016 | Holzberg et al. |
| 9,290,982 | B2 | 3/2016 | Schuetz et al. |
| 2002/0030666 | A1 | 3/2002 | Philipp et al. |
| 2002/0143452 | A1 | 10/2002 | Losey et al. |
| 2004/0085079 | A1 | 5/2004 | Lin et al. |
| 2004/0178924 | A1 | 9/2004 | Gifford et al. |
| 2005/0114276 | A1 | 5/2005 | Hunter et al. |
| 2005/0231194 | A1 | 10/2005 | Baldi et al. |
| 2006/0267374 | A1 | 11/2006 | Jackson et al. |
| 2006/0293800 | A1 | 12/2006 | Bauer et al. |
| 2007/0072154 | A1 | 3/2007 | Akatsuka et al. |
| 2008/0068145 | A1 | 3/2008 | Weghaus et al. |
| 2008/0088188 | A1 | 4/2008 | Busch et al. |
| 2008/0195273 | A1 | 8/2008 | Matsuura et al. |
| 2008/0303685 | A1 | 12/2008 | Nakano et al. |
| 2009/0222174 | A1 | 9/2009 | Frommer et al. |
| 2009/0243826 | A1 | 10/2009 | Touge et al. |
| 2010/0256875 | A1 | 10/2010 | Gehin et al. |
| 2011/0118946 | A1 | 5/2011 | Reimann et al. |
| 2011/0234370 | A1 | 9/2011 | Briese et al. |
| 2011/0276234 | A1 | 11/2011 | Van Gastel |
| 2011/0313619 | A1 | 12/2011 | Washeleski et al. |
| 2012/0188078 | A1 | 7/2012 | Soles et al. |
| 2012/0290177 | A1 | 11/2012 | Wagenhuber et al. |
| 2013/0234733 | A1 | 9/2013 | Lange et al. |
| 2013/0234828 | A1 | 9/2013 | Holzberg et al. |
| 2013/0311039 | A1 | 11/2013 | Washeleski et al. |
| 2014/0032055 | A1 | 1/2014 | Holzberg et al. |
| 2014/0195073 | A1 | 7/2014 | Herthan |
| 2014/0285217 | A1 | 9/2014 | Van Gastel et al. |
| 2014/0324273 | A1 | 10/2014 | Russ et al. |
| 2014/0373447 | A1 | 12/2014 | Gunreben et al. |
| 2015/0019085 | A1 | 1/2015 | Ma |
| 2015/0128497 | A1 | 5/2015 | Schuetz et al. |
| 2015/0134208 | A1 | 5/2015 | Gunreben |
| 2015/0176322 | A1 | 6/2015 | Wuerstlein et al. |
| 2015/0176324 | A1 | 6/2015 | Ebert |
| 2015/0233167 | A1 | 8/2015 | Hiroshi |
| 2015/0258879 | A1 | 9/2015 | Mandzak |
| 2015/0262002 | A1 | 9/2015 | Matsunaga |
| 2015/0345205 | A1 | 12/2015 | Gunreben et al. |

FOREIGN PATENT DOCUMENTS

| | | | |
|---|---|---|---|
| DE | 102004055982 | | 6/2006 |
| DE | 102004057220 | | 6/2006 |
| DE | 102005042402 | | 3/2007 |
| DE | 102005055002 | | 5/2007 |
| DE | 202005020140 | | 6/2007 |
| DE | 10158533 | | 2/2009 |
| DE | 102009004384 | | 7/2009 |
| DE | 102008041354 | | 2/2010 |
| DE | 102009041555 | | 6/2010 |
| DE | 102009047066 | | 5/2011 |
| DE | 102009055778 | | 6/2011 |
| DE | 102010048144 | | 7/2011 |
| DE | 10 2010 018 164 | * | 8/2011 |
| DE | 102010006213 | | 8/2011 |
| DE | 102010002559 | | 9/2011 |
| DE | 10 2011 008 277 | * | 7/2012 |
| DE | 10 2012 104 915 | * | 12/2013 |
| DE | 102012013065 | | 1/2014 |
| DE | 102013006086 | | 1/2014 |
| DE | 102013010994 | | 1/2015 |
| DE | 102013114881 | | 6/2015 |
| DE | 102014101661 | | 8/2015 |
| EP | 0711977 | | 5/1996 |
| EP | 1422366 | | 5/2004 |
| EP | 2919095 | | 9/2015 |
| FR | 2943190 | | 9/2010 |
| GB | 2376075 | | 12/2002 |
| JP | 02055168 | | 2/1990 |
| JP | 6018547 | | 1/1994 |
| JP | 2007228640 | | 9/2007 |
| JP | 2008111886 | | 5/2008 |
| JP | 2009079353 | | 4/2009 |
| JP | 2010236184 | | 10/2010 |
| WO | 2005084979 | | 9/2005 |
| WO | 2007/006514 | | 1/2007 |
| WO | 2010076332 | | 7/2010 |
| WO | 2011092206 | | 8/2011 |
| WO | 2012052210 | | 4/2012 |
| WO | WO 2012/055518 | * | 5/2012 |
| WO | 2012/084111 | | 6/2012 |
| WO | 2013034252 | | 3/2013 |
| WO | 2013091839 | | 6/2013 |

OTHER PUBLICATIONS

Brose Fahrzeugteile Gmbh & CO.KG, "Sesam oeffne Dich. In: AutomobilKONSTRUKTION," Feb. 2012 (pp. 50-51), with English translation (4 pages).

European Search Report for EP Application No. 13713812.2 corresponding to U.S. Appl. No. 13/951,163 dated Oct. 31, 2013 (3 pages).

German Search Report for DE Application No. 102011112274.9 corresponding to U.S. Appl. No. 14/343,005, dated May 9, 2012 (4 pages).

International Search Report and Written Opinion for PCT/EP2013/063905 related to U.S. Appl. No. 14/412,511, dated Aug. 1, 2013 (8 pages) [English Translation].

International Search Report for PCT/EP2012/005234 related to U.S. Appl. No. 14/367,786, dated Jun. 14, 2013 (3 pages).

International Written Opinion for PCT/EP2012/005234 related to U.S. Appl. No. 14/367,786, dated Jun. 7, 2014 (10 pages).

Non Final Office Action Citation for U.S. Appl. No. 14/367,786 dated Feb. 1, 2016 (15 pages).

Non Final Office Action for U.S. Appl. No. 14/343,005, dated Feb. 11, 2016 (23 pages).

Non Final Office Action for U.S. Appl. No. 13/951,163, dated Dec. 17, 2014 (31 pages).

Non-Final Office Action for U.S. Appl. No. 14/412,511, dated Apr. 11, 2016 (20 pages).

Non-Final Office Action for U.S. Appl. No. 14/581,441, dated Jun. 3, 2016 (10 pages).

Notice of Allowance for U.S. Appl. No. 13/951,163, dated Nov. 6, 2015 (13 pages).

Office Action for KR Patent Application No. 10-2013-0087175 corresponding to U.S. Appl. No. 13/951,163 dated Jan. 21, 2015 (13 pages).

Search Report for German Application No. 102012014676.0 corresponding to U.S. Appl. No. 13/951,163, dated Jan. 18, 2013 (5 pages).

Search Report for German Patent Application No. 102012013065.1 related to U.S. Appl. No. 14/412,511, dated Jun. 28, 2013 (5 pages).

German Search Report for German Patent Application No. DE102016108702.5, dated Dec. 12, 2016 (7 pages).

International Search Report for application No. PCT/EP2012/003577 corresponding to U.S. Appl. No. 14/343,005, dated Oct. 26, 2012 (6 pages).

European Search Report for European Patent Application No. 17158669.6 dated Sep. 21, 2017 (6 pages).

* cited by examiner

CONTROL SYSTEM FOR A MOTORIZED CLOSURE ELEMENT ARRANGEMENT OF A MOTOR VEHICLE

CLAIM OF PRIORITY

This application claims the benefit of German Patent Application No. DE 10 2013 114 883.2, filed Dec. 25, 2013, the disclosure of which is incorporated by reference herein in its entirety.

FIELD OF THE TECHNOLOGY

Embodiments of the invention relate to a control system for a motorized closure element arrangement of a motor vehicle, and also to a method for driving a closure element arrangement of a motor vehicle.

BACKGROUND

Modern motor vehicles increasingly have motorized closure element arrangements having at least one closure element. Said closure elements may be, for example, doors, in particular sliding doors, hatches, in particular tailgates, boot lids, engine hoods, cargo space floors or the like, of a motor vehicle. In this respect, the term "closure element" has a broad meaning in the present case. The closure element generally has an associated drive arrangement which can serve for the motorized adjustment of the closure element, the motorized opening of a motor vehicle lock of the closure element, or the like.

One convenience function which is becoming increasingly important today is the automatic operation of the motorized tailgate of a motor vehicle. The known control system (DE 10 2011 112 274 A1) on which the invention is based performs this convenience function and is equipped with a linear capacitive distance sensor which measures distances transverse to its local extent. The distance sensor passes over an elongate sensor region in a longitudinal direction and is accommodated in a rear skirt of the motor vehicle.

The known control system is further equipped with a control arrangement which, as part of an operator control event monitoring process, monitors the distance sensor in order to check whether a predetermined operator control event in the form of an operator control movement cycle is present. In one variant, the operator control movement cycle is a transverse movement cycle in the form of a foot movement in a transverse direction. In response to this operator control event being detected, the closure element arrangement is driven by means of the control arrangement if a longitudinal movement of the operator in the longitudinal direction has additionally being detected. In this way, it is possible to ensure that the operator has already moved out of the region in which there is a risk of collision. The longitudinal movement of the operator is likewise detected by means of the distance sensor. To this end, the distance sensor has a changing sensitivity along a sensor extent.

Although DE 10 2011 112 274 A1 discloses that a longitudinal movement can be detected as an operator control event in principle, this detection serves only to make the motorized operation of the tailgate in response to the detection of an abovementioned transverse movement cycle more reliable.

A similar disclosure is provided by DE 10 2010 002 559 A1 which discloses a distance sensor which is segmented along a sensor extent. As a result of the segmentation, a longitudinal movement of the operator in the longitudinal direction can be detected, and therefore incorrect recordings which are based on such a longitudinal movement can be precluded.

One disadvantage with the known control system is the fact that the operator has to comply with a relatively strict prespecified operator control movement cycle in order to trigger the desired driving of the respective closure element. This is understood to be a restriction to operator control convenience.

The invention is based on the problem of designing and developing the known control system in such a way that the operator control convenience can be increased using simple means.

SUMMARY

The above problem is solved in a control system, embodiments of which are described herein.

The consideration that the control arrangement detects not only the transverse movement cycle as an operator control event and drives the closure element arrangement in response, but rather that the control arrangement detects a predetermined longitudinal movement cycle, which runs in the longitudinal direction, of a body part of an operator, in particular of a leg of an operator, as an operator control event as part of the operator control event monitoring process and drives the closure element arrangement in response, is important.

In accordance with the proposal, it has been identified that both a transverse movement cycle as such and also a longitudinal movement cycle as such can each be detected as an operator control event, these detection processes being followed by a respective driving of the closure element arrangement in response. In this case, the closure element arrangement can be driven differently depending on the movement cycle, as will be explained below.

The proposed solution may provide the user with the option of being able to execute operator control events not only by means of a transverse movement cycle, but also by means of a longitudinal movement cycle. Therefore, operator control convenience can be considerably increased given suitable design.

In an embodiment, the transverse movement cycle and the longitudinal movement cycle have an identical structure. Specifically, they are both based on a forward and backward movement of a body part of the operator, such as of a leg of the operator.

In an embodiment, the driving of the closure element arrangement is independent of whether a transverse movement cycle or a longitudinal movement cycle has been detected. In this case, the user is free to use whichever movement cycle he wishes in order to trigger the same driving of the closure element arrangement. This leads to a high level of operator control convenience since the operator can select the movement cycle most convenient to him in order to trigger driving of the closure element arrangement.

As an alternative to this, provision may be made for the driving of the closure element arrangement to depend on the selection of the movement cycle. The scope of functions of the control system can be maximized in this way.

If two distance sensors which run beside one another are provided, an embodiment leads to a simplification of the evaluation of the sensor measurement values. This is because a time offset between the sensor measurement values of the two distance sensors can be a characteristic of a longitudinal movement cycle, which characteristic can be detected in a particularly simple manner. According to various embodiments, it is proposed to this end, for example, to check the time offset between two measurement value pulses of the distance sensors in order to determine whether there is a minimum time offset. If yes, a necessary condition for the detection of the longitudinal movement cycle as the operator control event would be met.

Particularly simple detection both of a longitudinal movement cycle and also of a transverse movement cycle by sensors is described herein. This is because both movement cycles generate, possibly after standardization, sensor measurement value profiles of a distance sensor with substantially the same signal shapes. This may apply for both distance sensors 3, 4 illustrated here. In the simplest case, the same identification algorithm can be used for the longitudinal movement cycle and the transverse movement cycle.

Different advantageous variants are feasible for longitudinal movement detection. In an embodiment, at least one distance sensor for longitudinal movement detection has a sensor configuration which changes along the longitudinal direction, so that the body part of the operator which moves in the longitudinal direction generates changing sensor measurement values of the at least one distance sensor. In this way, longitudinal movement detection is possible, without the basic design of the distance sensor having to be changed.

In an embodiment, the distance sensor, for longitudinal movement detection, has a sensor configuration which changes periodically along the longitudinal direction by a period length. It is particularly important here for the period length to correspond at least to the extent of the longitudinal movement cycle in the longitudinal direction. This means that a longitudinal movement cycle is always located within this period length, and therefore periodically recurring sensor measurement values do not occur on account of the periodically changing sensor configuration. This would lead to ambiguity in the evaluation of the sensor measurement values and make detection of an operator control event complicated. In contrast to this, the longitudinal movement cycle can be detected as an operator control event using simple control-related means here.

In an embodiment, the distance sensor runs along the longitudinal direction in an alternating manner around a center line as part of the changing sensor configuration. An interesting fact in this case is that the sensor configuration can be achieved in an elegant manner by special laying of the distance sensor, without any intervention in the design of the distance sensor itself being necessary. Laying the distance sensor with a wave shape has been found to be particularly advantageous in this connection since the resulting measurement value profiles are comparatively simple to evaluate.

In various embodiments, at least one distance sensor is a capacitive distance sensor. According to various embodiments, the measurement electrode of the distance sensor can be designed as a round conductor and bent into the abovementioned, alternating shape. However, as an alternative, provision may also be made for a distance sensor to be designed as a flat conductor and to be pre-shaped, for example stamped out, in an abovementioned, alternating shape. The alternating shape can be implemented at minimum cost in both cases.

In some embodiments, an alternative for realizing a sensor configuration of the above type which changes along the longitudinal direction. In this case, the distance sensor has an associated shielding arrangement in order to change the capacitive measurement area in sections, this in turn having an effect on the sensor measurement values. In a refinement which is particularly simple to realize, the distance sensor is provided with corresponding shielding metal plates in sections.

A method for driving a closure element arrangement of a motor vehicle is described herein.

According to the further teaching, it is important that an above transverse movement cycle as such is detected as an operator control event and the closure element arrangement is driven in response, and further, that an above longitudinal movement cycle as such is detected as an operator control event and the closure element arrangement is driven in response.

Reference may be made to all statements made in relation to the manner of operation of the proposed control system which are suitable for explaining the proposed method.

In an embodiments, a control system for a motorized closure element arrangement of a motor vehicle, wherein at least one linear distance sensor, which measures distances transverse to its local extent and passes over an elongate sensor region (5*a*, 5*b*) in a longitudinal direction, is provided in order to detect operator control events in the form of operator movement cycles, wherein, as part of an operator control event monitoring process, a control arrangement monitors the at least one distance sensor in order to check whether a predetermined operator control event is present, wherein a longitudinal movement of a body part of an operator, in particular of a leg of an operator, in the longitudinal direction can additionally be detected by means of the at least one distance sensor, wherein the control arrangement detects a predetermined transverse movement cycle, which runs in a transverse direction, of a body part of an operator, in particular of a leg of an operator, as an operator control event as part of the operator control event monitoring process and drives the closure element arrangement in response, wherein the control arrangement detects a predetermined longitudinal movement cycle, which runs in the longitudinal direction, of a body part of an operator, in particular of a leg of an operator, as an operator control event as part of the operator control event monitoring process and drives the closure element arrangement in response, is provided.

In an embodiment, the closure element arrangement has a closure element and a drive arrangement which is associated with the closure element, and in that the control arrangement performs driving of the drive arrangement, in particular motorized adjustment of the closure element, depending on the result of the operator control event monitoring process, such as the control arrangement performs driving of the drive arrangement, in particular motorized adjustment of the closure element, in response to the detection of the operator control event which is based on the transverse movement cycle as such and also in response to the detection of the operator control event which is based on the longitudinal movement cycle as such.

In an embodiment, the transverse movement cycle and the longitudinal movement cycle comprise a forward and backward movement of the body part of the operator.

In an embodiment, the detection of the operator control event which is based on the transverse movement cycle is based directly on the distance measurement, and in that the detection of the operator control event which is based on the longitudinal movement cycle is based on the longitudinal movement detection.

In an embodiment, the driving of the closure element arrangement, which driving the control arrangement performs in response to the detection of the operator control event which is based on the transverse movement cycle, is identical to the driving of the closure element arrangement, which driving the control arrangement performs in response to the detection of the operator control event which is based on the longitudinal movement cycle, or in that the driving of the closure element arrangement, which driving the control arrangement performs in response to the detection of the operator control event which is based on the transverse movement cycle, is different to the driving of the closure element arrangement, which driving the control arrangement performs in response to the detection of the operator control event which is based on the longitudinal movement cycle.

In an embodiment, two distance sensors which run beside one another, such as which run parallel to one another, are provided.

In an embodiment, the longitudinal movement cycle in each case generates a measurement value pulse in the sensor measurement values of the two distance sensors, and in that, as part of the operator control event identification process, a necessary condition for the detection of the longitudinal movement cycle as an operator control event is a minimum time offset between these measurement value pulses of the distance sensors.

In an embodiment, the longitudinal movement cycle or the transverse movement cycle generate, possibly after standardization, sensor measurement value profiles of a distance sensor with substantially the same signal shapes.

In an embodiment, at least one distance sensor for longitudinal movement detection has a sensor configuration which changes along the longitudinal direction, so that a body part of the operator which moves in the longitudinal direction generates changing sensor measurement values of the at least one distance sensor.

In an embodiment, for longitudinal movement detection, at least one distance sensor has a sensor configuration which changes periodically along the longitudinal direction with a period length, such as the period length corresponds at least to the extent of the longitudinal movement cycle in the longitudinal direction.

In an embodiment, the at least one distance sensor runs along the longitudinal direction in an alternating manner around a center line as part of the changing sensor configuration, such as the at least one distance sensor runs in the longitudinal direction with a wave shape, or in that the at least one distance sensor runs along the longitudinal direction with a zigzag shape, or in that the at least one distance sensor runs along the longitudinal direction with a rectangular shape.

In an embodiment, at least one distance sensor is designed as a capacitive distance sensor and has a linear measurement electrode by means of which a capacitive measurement area can be generated, such as in that the measurement electrode is designed as a round conductor or as a flat conductor.

In an embodiment, wherein the measurement electrode is designed as a round conductor and is bent into the alternating shape, and/or in that the at least one distance sensor is designed as a flat conductor and is pre-shaped, in particular stamped out, into the alternating shape.

In an embodiment, a shielding arrangement for shielding sections of the capacitive measurement area is provided in order to generate the sensor configuration, which changes along the longitudinal direction, at least of one distance sensor.

In an embodiment, a method for driving a closure element arrangement of a motor vehicle, in particular by means of a control system as described herein, wherein at least one linear distance sensor, which measures distances transverse to its local extent and passes over an elongate sensor region in a longitudinal direction, is provided in order to detect operator control events in the form of operator movement cycles, wherein, as part of an operator control event monitoring process, the at least one distance sensor is monitored by means of a control arrangement in order to check whether a predetermined operator control event is present, wherein a longitudinal movement of a body part of an operator, in particular of a leg of an operator, in the longitudinal direction can additionally be detected by means of the at least one distance sensor, wherein a predetermined transverse movement cycle, which runs in a transverse direction, of a body part of an operator, in particular of a leg of an operator, is detected by means of the control arrangement as an operator control event as part of the operator control event monitoring process and the closure element arrangement is driven in response, wherein a predetermined longitudinal movement cycle, which runs in the longitudinal direction, of a body part of an operator, in particular of a leg of an operator, is detected by means of the control arrangement as an operator control event as part of the operator control event monitoring process and the closure element arrangement is driven in response, is provided.

BRIEF DESCRIPTION OF THE FIGURES

The invention will be explained in greater detail below with reference to a drawing which illustrates only one exemplary embodiment and in which.

DETAILED DESCRIPTION

The proposed control system 1 serves to drive a motorized closure element arrangement 2 of a motor vehicle. The closure element arrangement 2 has a closure element 2*a* which is designed as a tailgate.

The design of the closure element 2*a* as a tailgate of a motor vehicle is possible, in various embodiments. However, reference may be made to the introductory part of the description in respect of the broad meaning of the term "closure element". In this respect, all of the statements made in relation to a tailgate 2*a* correspondingly apply for all other types of closure elements.

In order to detect operator control events in the form of operator control movement cycles, the control system 1 has at least one linear distance sensor 3, 4 which measures distances transverse to its local extent. This means that the distance from a measurement body is measured transverse to the extent of the distance sensor there, that is to say to the local extent, at any point along the distance sensor 3, 4. A known way of realizing this distance sensor is as capacitive distance sensors having linear measurement electrodes which will be discussed further below.

Figure 3:
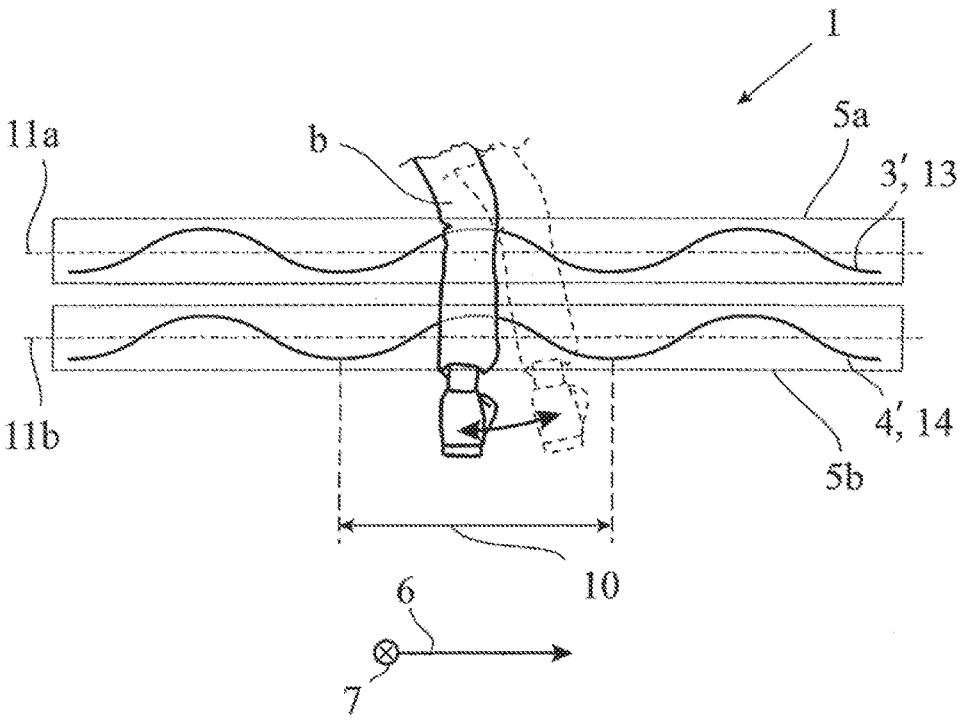
FIG. 3 shows a first embodiment of the two distance sensors of the proposed control system according to FIG. 1.
Figure 4:
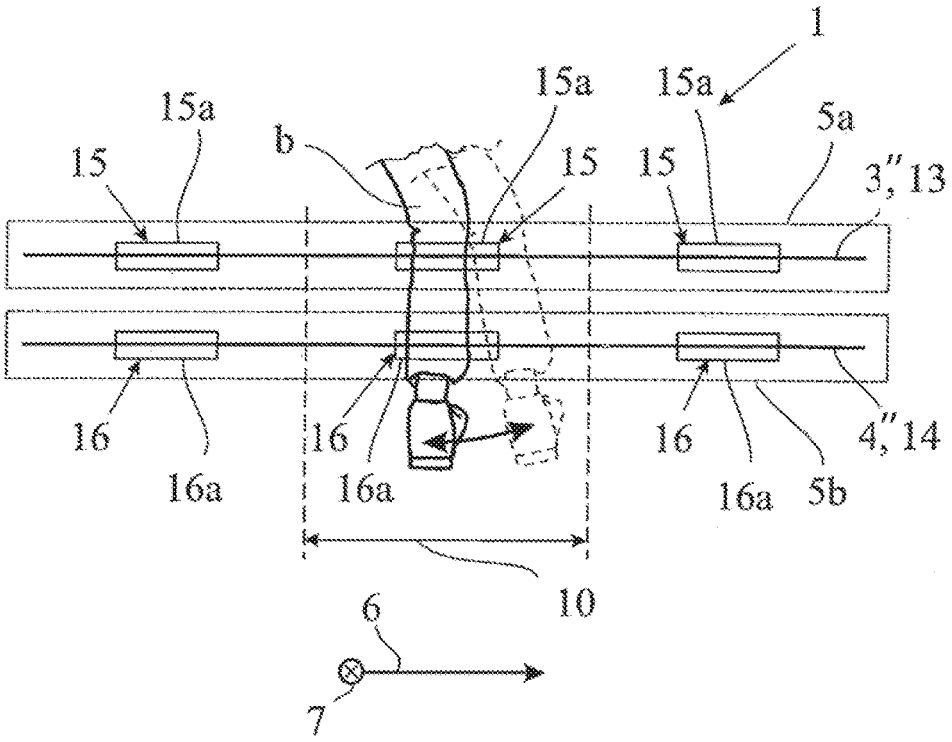
FIG. 4 shows a second embodiment of the two distance sensors of the proposed control system according to FIG. 1.

The at least one distance sensor 3, 4 passes over an elongate sensor region 5*a*, 5*b* in a longitudinal direction 6, as can best be seen from the illustrations according to FIGS. 3 and 4. The sensor region 5*a*, 5*b* can, in principle, be designed to be slightly bent.

The above movement cycles comprise predetermined movements of the operator B, which movements are intended to be detected as operator control events. Said movements can be movements of a body part, in particular of a leg b, of an operator B, as will be explained. The term "linear distance sensor" has a broad meaning in the present case and comprises all distance sensors with an elongate shape. These include, in particular, distance sensors with wire-like measurement electrodes.

The linear distance sensors 3, 4 are provided such that they determine a distance from a measurement body transverse to their respective local extent. This determination process may be the determination of an absolute distance. However, the term "distance sensor" in this case also comprises proximity sensors of a particularly simple design which provide only information about the entry of a measurement body into the detection region of the sensor. The term "distance sensor" also has a broad meaning in this respect. In principle, only a single distance sensor 3, 4 can be provided. However, in this case two distance sensors 3, 4 which run beside one another are provided. The associated advantage is explained further below. All of the statements made in relation to the at least one distance sensor 3, 4 correspondingly apply for a plurality of distance sensors, in particular for the two illustrated distance sensors 3, 4.

The embodiments illustrated in FIGS. 3 and 4 show that the distance sensors 3', 4', and 3", 4", respectively, each pass over an elongate sensor region 5*a*, 5*b* in the longitudinal direction 6. A transverse direction 7 is provided transverse to the longitudinal direction 6. The control system 1 is equipped with a control arrangement 8 which, as part of an operator control event monitoring process, monitors the at least one distance sensor 3, 4 in order to check whether a predetermined operator control event is present. In the exemplary embodiment which is illustrated, the control arrangement 8 has a central hardware structure. However, it is also feasible for the control arrangement 8 to have a decentralized hardware structure. In this case, some of the control hardware can be accommodated in the at least one distance sensor 3, 4. This means that the at least one distance sensor has its own intelligence which can serve, for example, for signal pre-processing.

Operator control event monitoring can firstly take place by means of the measured distance values. In the proposed control system 1, it is additionally the case that a longitudinal movement of a body part of an operator B, in particular of a leg b of an operator B, in the longitudinal direction can additionally be detected by means of the at least one distance sensor 3, 4.

In the case of the proposed solution, it is initially of interest that the control arrangement 8 detects a predetermined transverse movement cycle, which runs in the transverse direction 7, of a body part of an operator B, in particular of a leg b of an operator B, as an operator control event as part of the operator control event monitoring process and drives the closure element arrangement 2 in response. A transverse movement cycle of this kind is shown, by way of example, in FIG. 2*a*.

The fact that the control arrangement 8 additionally detects a predetermined longitudinal movement cycle, which runs in the longitudinal direction 6, of a body part of an operator B, here a leg b of an operator B, as an operator control event as part of the operator control event monitoring process and drives the closure element arrangement 2 in response, is now important. The longitudinal movement cycle is shown, by way of example, in FIG. 2*b*.

Therefore, according to the proposal, the transverse movement cycle as such and the longitudinal movement cycle as such, each independently of one another, trigger driving of the closure element arrangement 2.

It should be noted that the longitudinal movement cycle and the transverse movement cycle are defined in the longitudinal direction 6 and, respectively, in the transverse direction 7. However, it should also be noted that an operator movement will always have movement components both in the longitudinal direction 6 and also in the transverse direction 7. In this sense, the only important factor for the operator control event monitoring process is whether the respective operator movement comprises the predetermined longitudinal movement cycle.

Figure 1:
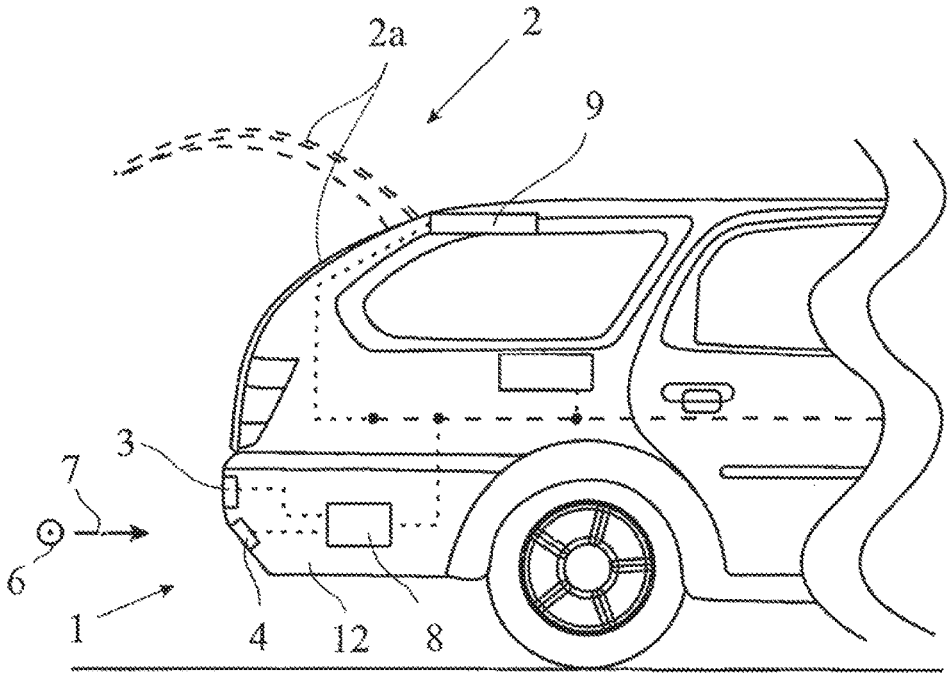
FIG. 1 shows a side view of the rear region of a motor vehicle having a proposed control system.

In an embodiment, the closure element arrangement 2 is, as discussed above, equipped with a closure element 2*a* and a drive arrangement 9 which is associated with the closure element 2*a*. Here, the closure element 2*a* can be adjusted between the closed position, illustrated using a solid line in FIG. 1, and the open position, illustrated using a dashed line in FIG. 1, in a motorized manner by means of the drive arrangement 9. As an alternative, the drive arrangement 9 can also be provided for motorized opening of a motor vehicle lock or the like.

Depending on the results of the operator control event monitoring process, the control arrangement 8 performs driving of the drive arrangement 9, in this case motorized adjustment of the closure element 2*a*. In principle, further actions can additionally be triggered by the control arrangement 8. Provision may further be made for the driving of the drive arrangement 9 and the further actions to be preceded by an authorization check with the operator B.

A particularly high level of operator control convenience can be achieved by the control arrangement 8 in each case performing driving of the drive arrangement 9, here motorized adjustment of the closure element 2*a*, in response to the detection of the operator control event, which is based on the transverse movement cycle, as such and also in response to the detection of the operator control event, which is based on the longitudinal movement cycle, as such possibly in addition to further actions. This is primarily of interest when the detection of the two operator control events triggers the same driving of the drive arrangement 9, for example the same motorized adjustment of the closure element 2*a*. In this case, the operator B can choose whether he wishes to carry out a longitudinal movement cycle or a transverse movement cycle for the motorized adjustment of the closure element 2*a*.

Figure 2A:
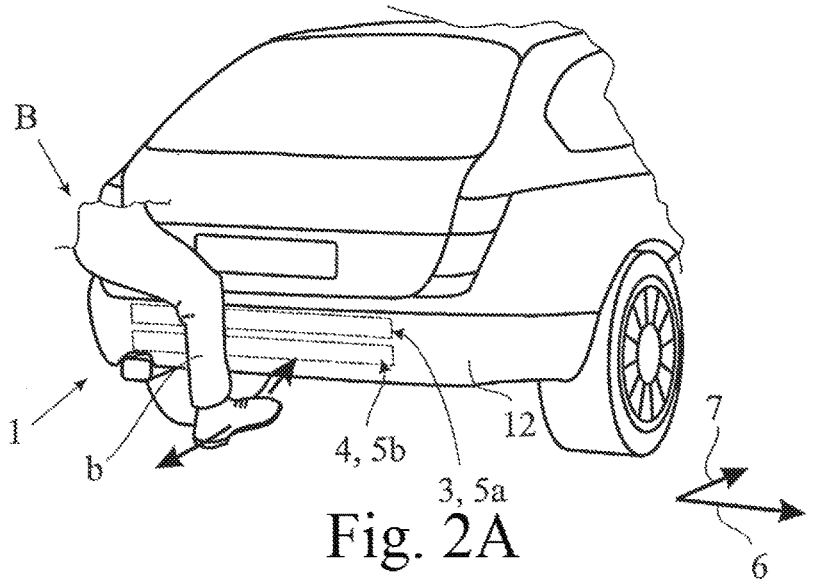
FIG. 2 shows a perspective view of the rear region of the motor vehicle according to FIG. 1 a) during a transverse movement cycle and b) during a longitudinal movement cycle.
Figure 2B:
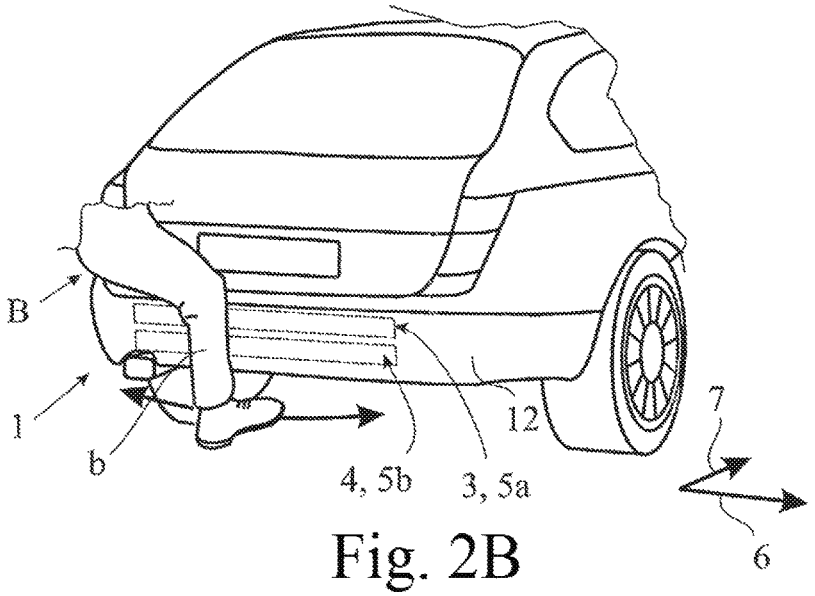

The proposed solution is particularly practical if both the transverse movement cycle and also the longitudinal movement cycle comprise a forward and backward movement of the body part of the operator B, in particular of a leg b of the operator B. In this case, the transverse movement cycle generally comprises a so-called "kicking movement" in the transverse direction 7, while the longitudinal movement cycle comprises a so-called "wiping movement" in the longitudinal direction 6. The kicking movement in the transverse direction 7 is shown in FIG. 2*a*, while the wiping movement in the longitudinal direction 6 is shown in FIG. 2*b*.

In an embodiment, the detection of the operator control event which is based on the transverse movement cycle is based directly on the distance measurement, and the detection of the operator control event which is based on the longitudinal movement cycle is based on the longitudinal movement detection. While the distance measurement is given by the original function of the distance sensor, the longitudinal movement detection is based on a sensor configuration which changes along the longitudinal direction 6, as will be explained further below.

In an embodiment, the driving of the closure element arrangement 2, which driving the control arrangement 8 performs in response to the detection of the operator control event which is based on the transverse movement cycle, is identical to the driving of the closure element arrangement 2, which driving the control arrangement 8 performs in response to the detection of the operator control event which is based on the longitudinal movement cycle. Therefore, it does not matter whether the operator executes the transverse movement cycle or the longitudinal movement cycle. The driving of the closure element arrangement 2 is identical each time. As an alternative, provision may be made for the driving of the closure element arrangement 2, which driving the control arrangement 8 performs in response to the detection of the operator control event which is based on the transverse movement cycle, to be different to the driving of the closure element arrangement 2, which driving the control arrangement 8 performs in response to the detection of the operator control event which is based on the longitudinal movement cycle. As explained above, the scope of functions of the control system can be increased in this way.

Particularly simple detection of specific operator control events is possible since two distance sensors 3', 4', and 3", 4" which run beside one another, here which run parallel to one another, are provided, as shown in FIGS. 3 and 4, respectively. This means that an elongate, vertically oriented measurement body, which moves in the longitudinal direction 6 in FIG. 3 or FIG. 4, generates the same sensor measurement values in both distance sensors 3', 4', and 3", 4" if the two distance sensors 3', 4', and 3", 4" are otherwise of identical design. An interesting effect which occurs when a leg movement of the operator B is detected can be observed in FIG. 3. Said figure shows that, as a result of the leg b being in a certain inclined position during the abovementioned wiping movement, the two distance sensors 3', 4' are influenced by the leg b of the operator B in different longitudinal positions along the longitudinal direction 6. This leads to the same measurement value pulse being generated in both distance sensors 3', 4', but the said measurement value pulses having a certain time offset. This time offset can be detected particularly easily by the two distance sensors 3', 4' running parallel to one another.

The above time offset can, in addition to other evaluation criteria, represent a necessary condition for detecting the longitudinal movement cycle as the operator control event. Specifically, it is the case that the longitudinal movement cycle in each case generates a measurement value pulse in the sensor measurement values of the two distance sensors 3', 4', and that, as part of the operator control event monitoring process, a necessary condition for the detection of the longitudinal movement cycle as an operator control event is a minimum time offset between the measurement value pulses of the distance sensors 3', 4'.

A design of the control system 1 involves the longitudinal movement cycle and the transverse movement cycle generating, possibly after standardization of the sensor measurement values, sensor measurement value profiles of a distance sensor 3, 4 with substantially the same signal shapes. This means that the longitudinal movement cycle generates, in the distance sensor 3, 4, a sensor measurement value profile which is identical to the sensor measurement value profile which is generated by the transverse movement cycle in this distance sensor 3, 4, possibly subject to standardization of the sensor measurement values. This can apply for both distance sensors 3, 4 illustrated here. As a result, it is possible for the same evaluation algorithm to be used in order to detect the longitudinal movement cycle and the transverse movement cycle as an operator control event.

For the purpose of longitudinal movement detection, provision is made here for at least one distance sensor 3, 4 to have a sensor configurations which changes along the longitudinal direction 6, so that the body part of the operator B which moves in the longitudinal direction 6 generates changing sensor measurement values of the distance sensor 3, 4. The term "sensor configuration" has a broad meaning and includes any parameter which exerts an influence on the sensor measurement values of the respective distance sensor 3, 4. Accordingly, the sensor configuration of a distance sensor 3, 4 is based on its geometry, its position, its material composition, any shielding measures or the like.

In the exemplary embodiment illustrated in FIG. 3, the sensor configuration which changes along the longitudinal direction 6 is based on the distance sensor 3', 4' being laid with a wave shape. In the exemplary embodiment illustrated in FIG. 4, the at least one distance sensor 3", 4" is electrically shielded in a manner yet to be explained. In the two exemplary embodiments, the distance sensors 3', 4', and 3", 4", are each capacitive distance sensors, as will be explained below.

For the purpose of longitudinal movement detection, at least one distance sensor 3, 4 can have a sensor configuration which changes periodically along the longitudinal direction 6 with a period length 10, so that the body part, which moves in the longitudinal direction 6, of the operator B generates changing sensor measurement values of the distance sensor 3, 4. In the present case, "period length" means a distance in the longitudinal direction 6 at which the change in the sensor configuration is repeated. This is best shown in the illustration according to FIG. 3. Here, the period length 10 corresponds at least to the extent of the predetermined longitudinal movement cycle, which is to be detected as an operator control event, in the longitudinal direction 6. This is particularly advantageous in as much as the evaluation of the sensor measurement values requires particularly little expenditure.

FIG. 3 shows that the at least one distance sensor 3', 4' runs along the longitudinal direction 6 in an alternating manner around a center line 11*a*, 11*b* as part of the changing sensor configuration. In this case, the center line 11*a*, 11*b* is oriented in the longitudinal direction 6. Depending on the manner of operation of the distance sensor 3', 4', a profile which Alternates in this way has different effects on the sensor measurement values. For example, the alternating profile can result in slight changes in the distance from a measurement body which moves in the longitudinal direction 6 which have an effect on the sensor measurement values. Furthermore, when the distance sensors 3, 4 are designed as capacitive distance sensors, it is the case, for example, that the shape of the respective distance sensor 3, 4 approximates the shape of the measurement body itself sometimes to a greater extent and sometimes to a lesser extent in the case of a measurement body which moves in the longitudinal direction 6, this being accompanied by a corresponding change in the resulting capacitance between the distance sensor 3, 4 and measurement body, and therefore by a change in the sensor measurement values. This appears to be the case provided that the measurement body is a leg b of a user B which is merely indicated in FIGS. 3 and 4.

Numerous variants are feasible for the specific shape of the distance sensor 3, 4 which runs in an alternating manner. Here, the at least one distance sensor 3', 4' runs along the longitudinal direction 6 with the shape of a wave, as shown in FIG. 3. As an alternative to this, the at least one distance sensor 3, 4 can run along the longitudinal direction 6 with a zigzag shape, a rectangular shape or the like.

The at least one distance sensor 3, 4 can be arranged along a rear panelling part 12, here the rear bumper, of the motor vehicle. The at least one distance sensor 3, 4 can run over the entire width of the panelling part 12. If the at least one distance sensor 3, 4 has an alternating profile, it is optionally the case that, in the installed state, the position of the distance sensor 3, 4 alternates substantially vertically along the longitudinal direction 6.

In an embodiment, at least one distance sensor 3, 4 is designed as a capacitive distance sensor. Here, the two distance sensors 3, 4 are capacitive distance sensors. Accordingly, the two distance sensors 3, 4 each have a linear measurement electrode 13, 14 by means of which a capacitive measurement area can be generated. The distance measurement is based on the detection of a change in capacitance which accompanies the insertion of a measurement body into the measurement area.

Different designs of the at least one measurement electrode 13, 14 are feasible depending on the structural and electrotechnical boundary conditions. Measurement electrodes which are designed as round conductors or as flat conductors have proven expedient in practice.

If the at least one measurement electrode 13, 14 is designed as a round conductor, the measurement electrode 13, 14 can be converted into the abovementioned, alternating shape in a particularly simple manner. As a result, standard starting material can readily be used for the at least one measurement electrode 13, 14. If the measurement electrode 13, 14 is designed as a flat conductor, provision may be made for the measurement electrode 13, 14 to be pre-formed, in particular stamped out, into the alternating shape during the course of its production. Optimum homogeneity of the material of the measurement electrode 13, 14 can be ensured in this way.

Referencing FIG. 4, another embodiment for generating the sensor configuration, which changes along the longitudinal direction 6, of the at least one distance sensor 3", 4" is based on the at least one distance sensor 3", 4" being shielded in sections along the longitudinal direction 6. Specifically, it is proposed that a shielding arrangement 15, 16 for shielding at least sections of the capacitive measurement area is provided in order to generate the sensor configuration, which changes along the longitudinal direction 6, at least of one distance sensor 3", 4". Owing to a shielding arrangement 15, 16 of this kind, the capacitive measurement area can be modulated to a certain extent along the longitudinal direction 6, this in turn having a corresponding effect on the sensor measurement values. The shielding arrangement 15, 16 can have, for example, a metal shielding plate 15*a*, 16*a* which, in an embodiment, surrounds the respective distance sensor 3", 4" in sections. Numerous variants are feasible for the design of the metal shielding plate 15*a*, 16*a*. By way of example, the metal shielding plate 15*a*, 16*a* can at least partially surround the respective distance sensor 3", 4" substantially in the manner of a basket. FIG. 4 schematically shows an embodiment. One special feature here is that the shielding is arranged on that side of the measurement electrode 13, 14 which is averted from the operator. It may be advantageous to connect the shielding arrangement 15, 16 to the electrical earth of the vehicle.

A method for driving a closure element arrangement 2 of a motor vehicle, in particular by means of a control system 1 according to the first-mentioned teaching, is described herein.

According to this further teaching, as part of the operator control event monitoring process, the at least one distance sensor 3, 4 is monitored by means of the control arrangement 8 in order to check whether a predetermined operator control event is present, wherein a longitudinal movement of a body part of an operator B, in particular of a leg b of an operator B, in the longitudinal direction 6 can additionally be detected by means of the at least one distance sensor 3, 4, wherein a predetermined transverse movement cycle, which runs in a transverse direction 7, of a body part of an operator B, in particular of a leg b of an operator B, is detected by means of the control arrangement 8 as an operator control event as part of the operator control event monitoring process, and the closure element arrangement 2 is driven in response.

According to this further teaching, it is important that a predetermined longitudinal movement cycle, which runs in the longitudinal direction 6, of a body part of an operator B, in particular of a leg b of an operator B, is detected by means of the control arrangement 8 as an operator control event as part of the operator control event monitoring process and the closure element arrangement 2 is driven in turn in response.

Reference may be made to all of the statements made in relation to the manner of operation of the proposed control system 1 which are suitable for explaining the proposed method.

What is claimed is:

1. A control system for a motorized closure element arrangement of a motor vehicle, comprising at least one linear distance sensor having a longitudinal extent that extends in a longitudinal direction over an elongate sensor region, and a control arrangement that simultaneously monitors the at least one distance sensor for an operator control event as part of an operator control event monitoring process, wherein the at least one linear distance sensor is configured to measure a distance to a body part of an operator and detect a longitudinal movement of the body part of the operator in the longitudinal direction, wherein the distance to the body part of the operator is transverse to the longitudinal extent of the at least one linear distance sensor, wherein the control arrangement is configured to detect one of a transverse movement cycle of the body part of the operator as the first operator control event and a longitudinal movement cycle of the body part of the operator as the second operator control event, wherein in the transverse movement cycle the body part of the operator moves in a transverse direction with respect to the longitudinal direction, and wherein the control arrangement drives the closure element arrangement in response to detecting either one of the transverse movement cycle and the longitudinal movement cycle.

2. The control system according to claim 1, wherein the closure element arrangement has a closure element and a drive arrangement which is associated with the closure element, and wherein the control arrangement controls the drive arrangement depending on the operator control event monitoring process.

3. The control system according to claim 2, wherein the control arrangement drives the drive arrangement, in response to the detection of the first operator control event and also in response to the detection of the second operator control event.

4. The control system according to claim 1, wherein the transverse movement cycle and the longitudinal movement cycle each comprise a forward and backward movement of the body part of the operator.

5. The control system according to claim 1, wherein the detection of the first operator control event is based directly on the distance measured by the at least one distance sensor, and wherein the detection of the second operator control event is based on the longitudinal movement of the body part of the operator.

6. The control system according to claim 1, wherein the control arrangement drives the closure element arrangement, identically in response to detecting the first operator control event or the second operator control event.

7. The control system according to claim 1, wherein the at least one distance sensor comprises two distance sensors.

8. The control system according to claim 7, wherein the two distance sensors run parallel to one another.

9. The control system according to claim 7, wherein the longitudinal movement cycle generates a measurement value pulse in each of the two distance sensors, and wherein the detection of the longitudinal movement cycle comprises determining whether there is a minimum time offset between the measurement value pulses of the distance sensors.

10. The control system according to claim 1, wherein the at least one distance sensor generates sensor measurement value profiles with substantially the same signal shape for both the longitudinal movement cycle and the transverse movement cycle.

11. The control system according to claim 1, wherein the at least one distance sensor has a sensor configuration which changes along the longitudinal direction, so that the longitudinal movement of the body part of the operator generates changing sensor measurement values.

12. The control system according to claim 11, wherein the sensor configuration comprises a shielding arrangement for shielding sections of the at least one distance sensor.

13. The control system according to claim 11, wherein the sensor configuration of the at least one distance sensor changes periodically along the longitudinal direction.

14. The control system according to claim 13, wherein the periodically changing sensor configuration comprises a period with a length that corresponds at least to the length of the longitudinal movement cycle of the body part of the operator in the longitudinal direction.

15. The control system according to claim 11, wherein the at least one distance sensor runs along the longitudinal direction in an alternating manner across a center line.

16. The control system according to claim 15, wherein the at least one distance sensor comprises a capacitive distance sensor and has a measurement electrode.

17. The control system according to claim 16, wherein the measurement electrode comprises one of a round conductor and a flat conductor.

18. The control system according to claim 16, wherein the measurement electrode has an alternating profile with respect to the center line and comprises one of a round conductor and a flat conductor.

19. A method of driving a closure element arrangement of a motor vehicle comprising, measuring, with at least one linear distance sensor, a distance to a body part of an operator, the distance being transverse to a longitudinal extent of the at least one linear distance sensor that extends in a longitudinal direction over an elongate sensor region, monitoring, as part of an operator control event monitoring process, the at least one linear distance sensor with a control arrangement that simultaneously monitors the at least one distance sensor for a first operator control event and a second operator control event, wherein a longitudinal movement of the body part of the operator in the longitudinal direction can be detected with the at least one distance sensor, monitoring the at least one linear distance sensor with the control arrangement for a transverse movement cycle of the body part of the operator as the first operator control event, the transverse movement cycle of the body part of the operator extending in a transverse direction with respect to the longitudinal direction, monitoring the at least one linear distance sensor with the control arrangement for a longitudinal movement cycle of the body part of the operator as the second operator control event, the longitudinal movement cycle of the body part of the operator extending in the longitudinal direction, detecting, with the control arrangement, the transverse movement cycle as the first operator control event, or the longitudinal movement cycle as the second operator control event, and driving the closure element arrangement in response to detecting either one of the transverse movement cycle and the longitudinal movement cycle.

* * * * *